US005356360A

United States Patent [19]

Johns

[11] Patent Number: 5,356,360

[45] Date of Patent: Oct. 18, 1994

[54] ADJUSTABLE LEVER ARM-VARIABLE RESISTANCE CAM ASSEMBLY

[75] Inventor: George Johns, Richardson, Tex.

[73] Assignee: Titan Exercise Equipment, Inc., Carrollton, Tex.

[21] Appl. No.: 883,569

[22] Filed: May 15, 1992

[51] Int. Cl.[5] ..... A63B 21/062

[52] U.S. Cl. ..... 482/99; 482/100; 482/137

[58] Field of Search ..... 482/97-103, 482/133-138, 908

[56] References Cited

U.S. PATENT DOCUMENTS

| | | | |
|---|---|---|---|
| 2,855,199 | 10/1958 | Noland et al. | 482/97 |
| 4,502,681 | 3/1985 | Blomqvist | 482/97 X |
| 4,600,189 | 7/1986 | Olschansky et al. | 482/100 |
| 4,709,920 | 12/1987 | Schnell | 482/100 |
| 4,911,431 | 3/1990 | Parviainen | 482/99 |
| 4,982,955 | 1/1991 | Heasley | 482/100 |
| 4,982,956 | 1/1991 | Lapcevic | 482/100 |
| 5,102,121 | 4/1992 | Solow | 482/137 X |

FOREIGN PATENT DOCUMENTS 3445104 6/1986 Fed. Rep. of Germany ..... 482/100

*Primary Examiner*—Robert Bahr

*Attorney, Agent, or Firm*—Johnson & Wortley

[57] ABSTRACT

An adjustable lever arm—variable resistance cam assembly employing a cam for producing therefrom a variable resistance force when a constant resistance force is applied thereto and in which the lever arm may be initially positioned at a range of angular positions without thereby affecting the variable resistance force produced by the cam at each particular angular position of the lever arm upon rotation thereof. The adjustable lever arm—variable resistance cam assembly may be employed in a weight lifting machine or device of the type having a rotating lever arm for application of weight lifting force by the user. The assembly allows the user to angularly adjust the initial position of the lever arm in relation to the axis of the cam and, nevertheless, maintain the cam in appropriate relation with the constant resistance force. The variable resistance force produced by the cam will then not vary with respect to positioning of the lever arm as rotated during exercise.

10 Claims, 4 Drawing Sheets

ADJUSTABLE LEVER ARM-VARIABLE RESISTANCE CAM ASSEMBLY

FIELD OF THE INVENTION

The present invention relates to an adjustable lever arm—variable resistance cam assembly. More particularly, the invention relates to a cam assembly which may be used in weight lifting equipment, the cam assembly allowing for adjustment of a lever arm integrated therewith such that appropriate resistance force may be maintained against the lever arm at various positions thereof irregardless of its initial position.

BACKGROUND OF THE INVENTION

Weight lifting is a popular sport and fitness pastime. The popularity of weight lifting has increased significantly in recent years. Weight lifting can serve a number of purposes, including, for example, body building, toning, strengthening, exercise and rehabilitation. A variety of weight lifting styles and strategies have developed. The particular weight lifting styles and strategies for achieving particular ones of such purposes vary. Generally, such styles and strategies take the form of various weight lifting exercises in which particular lifts are employed using particular muscles of the body. The results achieved through a particular style and strategy in weight lifting is thus varied by the particular exercise procedures and methods pursued.

A wide variety of weight lifting exercise procedures and methods have developed. Weight lifting may be accomplished through so-called "free weights", which consist essentially of a weight, generally attached to some form of handle, which the user grasps and lifts by use of particular muscles of the body. On the other hand, numerous weight lifting machine devices have been designed to further particular weight lifting goals.

Weight lifting machine devices take on a variety of styles, shapes and forms. Such devices are typically designed to further particular muscle development goals sought to be achieved by the user through the use of the devices in weight lifting exercises. Certain of such devices tend to be geared towards use in developing particular muscles or particular sets of muscles of the user's body. For example, a number of such devices are directed to use in developing leg muscles of the user, such as knee extension and leg lift machines.

The various mechanical machine devices designed for use in weight lifting typically provide greater ease of use, more efficient weight lifting exercise, and some degree of versatility over traditional free weights. In addition, such machines, in some instances, enable the user, in some measure, to regulate resistance force during particular exercises and also offer other desirable aspects. Regulation of resistance force is in many circumstances advantageous in that the regulation may be used to emphasize resistance at certain points, critical to desired muscle development, during a particular exercise and to de-emphasize resistance at certain other points during such exercise, critical to limit potential injury to muscles or other parts of the user's body. It is, therefore, very desirable to include a mechanism in a weight lifting machine device which provides a varying resistance force during performance of the weight lifting exercises. A design goal for many designers of weight lifting devices is to provide a mechanism for creating such a variable resistance.

Weight lifting machine devices often also employ a lever arm assembly which operates against a resistance force typically provided by sets of weights or other resistance means. Such a lever arm is generally designed to be moveable by the user when weight lifting force is applied by the user to the arm in sufficient magnitude to overcome the resistance force. Though a variety of configurations for weight lifting machine devices are possible, a typical configuration includes a set of weights positioned for upward vertical movement in response to weight lifting force. Additionally, such a machine typically includes a lever arm assembly for application of weight lifting force by the user. The lever arm is generally rotatably movable within a semicircular range. The weights are connected with the lever arm by a cable or chain linkage, such that angular movement of the lever arm is synchronous with vertical, upward movement of the weights. Various pulleys and levers may also be employed with the cable or chain linkage for translating the force and movement of the lever arm to vertical, upward force operating against the resistance force of the weights causing the weights to move vertically and upward.

A recent trend in design of weight lifting machine devices is to direct the designs to particular exercise uses or particular muscle development goals. Improvements have been made in the particular mechanisms employed in such devices to achieve such goals. As an example, it has been determined that users often do not want the lever arm to move in its typical full range of semicircular movement. Further, it has been determined that users will at times prefer to adjust the initial starting position of the lever arm. Designers have recognized these desires of users and have at times incorporated mechanisms for adjusting the starting position and the range of movement of lever arms in such machines. Additionally, it has been determined that preferred weight lifting conditions dictate a variable resistance, rather than constant resistance, against a lever arm through its range of motion. Such a variable resistance mechanism has been incorporated into a number of weight lifting machines by designers.

The adjustable lever arm-variable resistance cam mechanisms exhibited in the prior art weight lifting machine devices present a number of problems in their use. Such mechanisms are often complex involving an aggregation of numerous gears, pulleys, lever arms, chains, cables, and other elements. Further, such prior art mechanisms have often not provided for a variable resistance that is, at each particular angular point of movement of a lever arm, the same, irregardless of initial positioning of the lever arm or of range of semicircular movement thereof. In the prior art, the variable resistance often differs as a result of varied initial positioning of a lever arm. Such differing variable resistance, due to varied initial positioning, may result, for example, from vertical movement and thus different initial positioning of the weights in response to adjustment of the lever arm to such varied initial positions. In addition to such differing variable resistance, such prior art mechanisms have proven breakable, complicated in assembly, costly, and/or combinations of these and a host of numerous other problems.

The present invention is an adjustable lever arm-variable resistance cam mechanism for use in an exercise machine or other lifting device which overcomes the problems presented by the prior art. In providing for such a mechanism, the invention includes a cam allowing for various adjustment of initial positioning of a lever arm attached thereto, which cam, upon initial positioning of the lever arm, is thereby automatically adjusted to create appropriate variable resistance from a weight set linked thereto in response to forcible movement of the lever arm by the user.

SUMMARY OF THE INVENTION

The present invention relates to a cam assembly, against which is directed an angular resistance force. More particularly, one aspect of the present invention includes a cam, rotatably mounted and securable in various rotational relationship to the angular resistance force, and a counteracting means, being secured with the cam such that the cam and the counteracting means rotate in synchrony. The counteracting means is suitable for application of angular counteracting force against the cam to act against the angular resistance force when the cam is secured in rotational relationship to the angular resistance force. The assembly further includes a variable resistance means incorporated with the cam for causing the angular resistance force applied against the cam assembly to vary, in accordance with specific configuration of the variable resistance means, with respect to the counteracting means when the counteracting means is rotated after the cam is secured in rotational relationship to the angular resistance force. Finally, the assembly includes a continuity means which allows the cam to rotate into position for securement in particular rotational relationship to the angular resistance force. The continuity means allows said cam to be so rotated free of the angular resistance force, into such position with respect to the angular resistance force. The continuity means further maintains the angular resistance force in proximity to the cam, providing for securement of the cam in particular rotational relationship to the angular resistance force, and, once so secured, causes the angular resistance force to act against the cam.

I n another aspect, the invention includes the above described assembly, wherein the variable resistance means is formed in the cam. The cam is oval-shaped and, thus, has a varying radius extending from the cam's rotational axis to the cam's circumferential perimeter and proceeding therealong. The angular resistance force is fixed in a tangential direction at the cam's circumferential perimeter such that the cam varies the angular resistance force with respect to the counteracting means due to the varying radius as the cam rotates when secured in rotational relationship to the angular resistance force.

In yet another aspect, the invention includes the above described assembly wherein the angular resistance force is produced by a cable partially wrapping the cam's circumferential perimeter and in engagement therewith such that rotation of the cam moves the cable and movement of the cable rotates the cam. Further, the counteracting means may be a lift arm connected with the cam in rotational securement therewith.

In another aspect, the invention includes the above described assembly, wherein the continuity means is a positioning arm engageable with the cam. The positioning arm is rotatable independent of the cam when disengaged with the cam but rotatable in synchrony with the cam when engaged therewith. The positioning arm further includes a cable positioning arm forming a part thereof. The cable positioning arm incorporates a cable tension pin serving as a rotational axis for a cable tension arm. Movement of the cable tension arm is limited in a manner which, when the positioning arm is disengaged with the cam, maintains a cable partially wrapping the cam's circumferential perimeter for producing the angular resistance force in close proximity with the cam but allows the cam to freely rotate, and when the positioning arm is engaged with the cam, maintains the cable in particular rotational relationship with the cam such that tension of the cable produces the angular resistance force against the cam.

In a further aspect, the invention comprises an adjustable lever arm - variable resistance cam assembly in a weight lifting device, the weight lifting device including a vertically movable weight set and a lift arm against which a user may exert force to lift the weight set. Such assembly includes a cable attached at a weight set by one end, and a cam, rotatably secured upon the weight lifting device, such cam having a cable guide around the circumferential perimeter thereof, the cable passing within the cable guide. The invention also includes a lift arm securely connected with the cam such that rotation of the lift arm by a user upon exerting force thereagainst also rotates the cam. A positioning arm is rotatably mounted thereon and a means for selectively securing the cam with the positioning arm for synchronous rotation thereof is included therewith. The cam and the positioning arm synchronously rotate when the means is engaged, and the cam and the positioning arm independently rotate when the means is not engaged. The invention additionally includes a cable tension arm rotatably mounted to the positioning arm. The cable tension arm has dual arms, one of the arms including a cable securing bolt secured with the other end of the cable and the other of the arms including a ridge roller guide. Finally, the invention exhibits a guide ridge incorporated with the cam. The guide ridge guides the ridge roller guide of the cable tension arm for positioning the cable tension arm to appropriately tension the cable as necessary to maintain the cable within the cable guide of the cam. The guide ridge allows tolerance in engagement of the cable with the cable guide when the means for selectively securing the cam is not engaged in a manner allowing the cam to freely rotate in relation to the cable. The guide ridge further provides for secure engagement of the cable with the guide ridge, such that the cam rotates with movement of the cable and the cable moves with rotation of the cam, when the means for selectively securing the cam is engaged.

In other aspects of the adjustable lever arm - variable resistance cam assembly, the cam is oval-shaped; the lift arm is adjustably positionable by the user linearly along the lift arm's rotational radius; or the means for selectively securing the cam with the positioning arm is a position lock pin incorporated with the positioning piece for matching engagement with any of an array of positioning holes included in the cam to rotatably secure the positioning piece with the cam. Further, the adjustable lever arm - variable resistance cam assembly may include at least one rotation stop. Such a rotation stop limits the rotational range of the cam when the positioning arm is not engaged by the means for selectively securing the cam such that the cam is freely rotatable in relation to the cable. The assembly may also include a bumper arm. The bumper arm functions to restrict rotation of the cam when the positioning arm is engaged with the cam by the means for selectively securing the cam such that the cam is only rotatable by movement of the cable and the cable is only moveable by rotation of the cam. Such a bumper arm may be formed from the positioning arm.

In another aspect, the invention includes a variable resistance cam assembly for a weight lifting device, the cam assembly including an oval-shaped cam and the cam being rotatable by a user against a resistance force created by a weight set engaged with the cam. In such invention, the cam exerts a variable force against a rotating lift arm during lifting exercise. The lift arm is rotatable by the user's exertion of force thereagainst sufficient to overcome the variable force. The variable force is determined by characteristics of the cam. Further in such invention, the lift arm is rotatable, free of the variable force, to varying initial positions and engageable with the variable force at any one of such varying initial positions. Additionally, the cam maintains the same relative relationship with the resistance force, irregardless of initial positioning of the lift arm, thereby creating variable resistance against the lift arm which, at every angular position in rotation of the lift arm, is peculiar thereto over the range of rotation of the lift arm, irregardless of initial positioning of the lift arm.

In yet another aspect the invention is an improvement in a variable resistance cam assembly formed of a cam, a cable connected at one end to a weight set, and a positioning arm for selectively engaging with said cam for rotatable engagement therewith, wherein the improvement comprises a cable tension arm, pivotally mounted to the positioning arm for select angulation relative thereto and concomitant positioning of the cable's other end relative the cam, and a means for imparting angulation of the positioning arm in response to rotation of the cam relative to the positioning arm.

In another aspect, the invention includes the assembly and improvement described above, wherein the means is a guide ridge against which the cable tension arm is rollingly engaged in a manner causing the cable tension arm to angularly move to position the cable's other end relative to the cam when the cam is rotated with respect to the positioning arm.

Another aspect of the invention includes the assembly and improvement described above, wherein the positioning arm is formed from a positioning piece, which positioning piece is rotatable in synchrony with the cam when engaged therewith and otherwise rotatable free of rotation of the cam, the cable tension arm being pivotally attached to the positioning piece.

In another aspect of the invention including the assembly and improvement described above, the cam has a cable guide and the select angulation of the cable tension arm and the concomitant positioning of the cable's other end serve to retain the cable within the cable guide.

In yet another aspect of the invention including the assembly and improvements described above, the positioning arm is formed from a positioning piece, which positioning piece is engageable with the cam for synchronous rotation therewith, the select angulation of the positioning arm and concomitant positioning of the cable's other end causing the cable to wrap around the cam when said positioning piece is engaged with the cam and allowing the cam to rotate relative to the cable when the positioning piece is disengaged from the cam. In another aspect, a guide ridge affixed with the cam is abuttingly engaged with the cable tension arm for rotating the cable tension arm to cause the select angulation and concomitant positioning.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
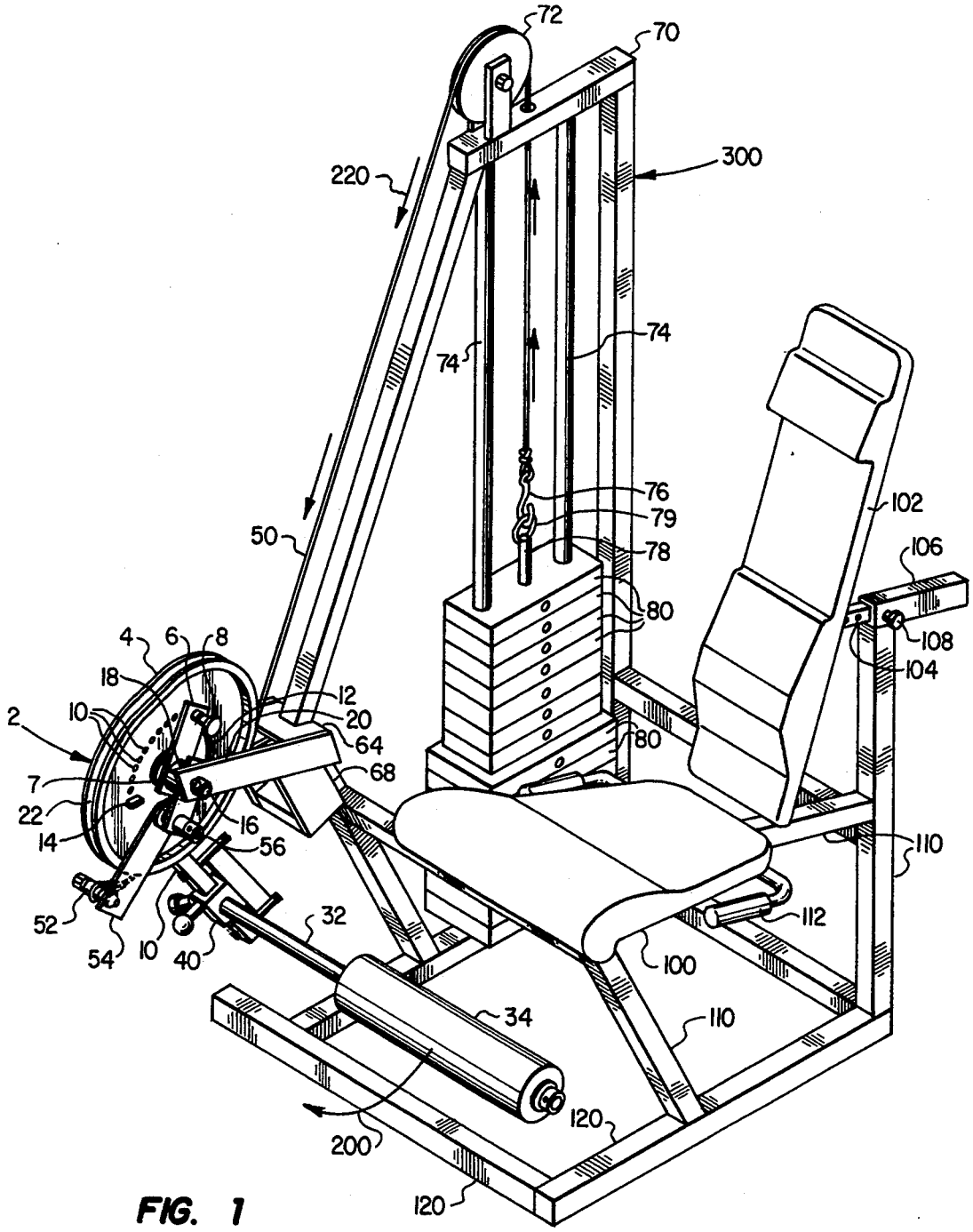
FIG. 1 is a perspective view of an exemplary weight lifting machine, incorporating the adjustable lever arm - variable resistance cam assembly of the present invention.

Referring first to FIG. 1, the present invention provides an adjustable lever arm - variable resistance cam assembly for employment in a weight lifting machine 300. The weight lifting machine 300 shown in FIG. 1 is intended only as a representative weight lifting device in which the cam assembly 2 may be employed, and employment of the cam assembly 2 in other weight lifting machines and other devices is also possible.

Still referring to FIG. 1, the representative weight lifting machine 300 is comprised of a frame base 120 which supports the weight lifting machine 300 structure on a surface, preferably level, such as a floor. Rising from the frame base 120 is a seat support frame 110 which provides support for a user seat 100. User seat 100 enables a user of the device to comfortably position himself in order to use the device. In addition to the user seat 100, a seat back 102 may be provided for further comforting the user. The seat back 102 may be adjustable, as shown in FIG. 1, by means of a back adjustment bar 104 which fits within a back adjustment sleeve 106 and is held in fixed position by a back adjustment pin 108. Alternative seat configurations, including adjustment mechanisms therefor, may be employed in a weight lifting device suitable for use with the current invention. The seat support frame 110 may also incorporate hold handles 112 which allow the user a gripping surface for secure positioning in the seat when using the device.

Still referring to FIG. 1, the frame base 120 further incorporates a weight support frame 70. Such a weight support frame 70 provides support for a weight set 80. The weight set 80 is preferably positioned to move vertically upward in response to application of weight lifting force to the weight lifting machine 300 by a user in the manner hereinafter described. In the preferred embodiment of the representative weight lifting machine 300 shown in FIG. 1, the weight set 80 is supported for movement along a vertical path by weight guide arms 74. Additionally, a weight bar 78 is incorporated with the weight set 80 to provide a mechanism for connecting the weight set 80 with a means, as hereinafter described, against which the user may exert force thereby lifting the weight set 80. In the particular embodiment shown in FIG. 1, the weight bar 78 incorporates an eyelet 79 for ease in connection with such mechanism and means.

The weight support frame 70 further incorporates a cam support 68. The cam support 68 supports dual cam support arms 20 which provide a means for affixing the cam assembly 2 of the invention to the weight support frame 70. The cam assembly 2 is interconnected with the weight set 80 by a cable 50, in a preferred embodiment. The interconnection is effected in a manner such that rotational movement of the cam assembly 2 in response to weight lifting force exerted by a user causes the weight set 80 to vertically rise when sufficient weight lifting force to overcome resistance of the weight set 80 is applied. In a preferred embodiment, the cable 50 may be connected to the eyelet 79 by a weight hook 76 allowing for variation of the weight set 80 and form of resistance force by connection thereto. When the cam assembly 2 is rotated due to application of weight lifting force, the cable tensions and moves with the cam assembly 2 to vertically, upwardly move the weight set 80. In a preferred embodiment, the cable 50 rides within the guides of a pulley 72, which pulley 72 translates the force and motion of the cable 50 to force and move the weight set 80 vertically upward. The cable 50 connects with the cam assembly 2 at the cable securing bolt 52.

Figure 2:
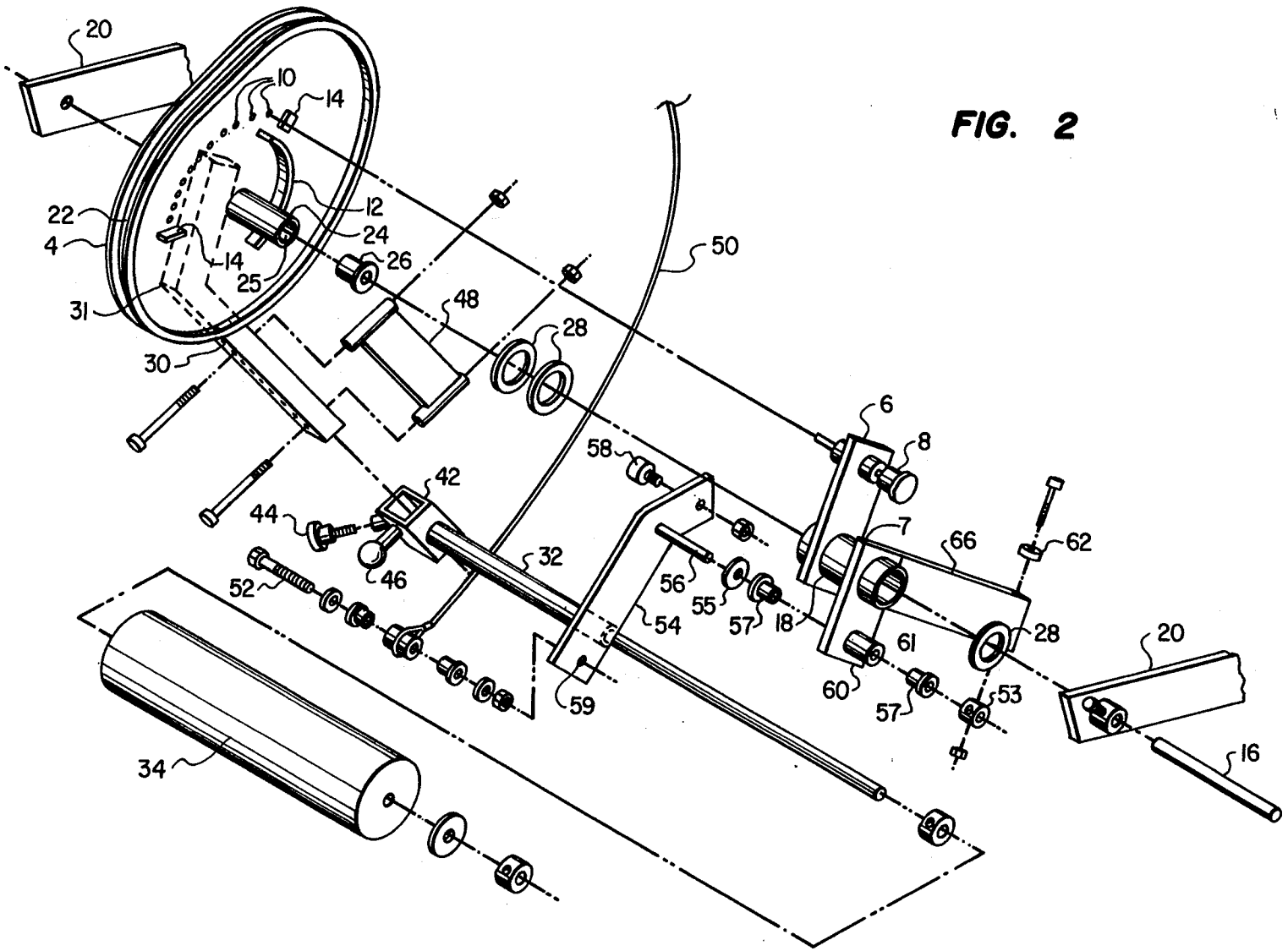
FIG. 2 is an exploded, detailed perspective view of the adjustable lever arm - variable resistance cam assembly of FIG. 1, together with support structure elements and cable incorporation mechanism.

Referring now to FIG. 2, the cam assembly 2 is shown. It is intended to be understood hereby that the hereinbefore described aspects of the weight lifting device 300 may take any of a number of forms or designs and that the cam assembly 2 of the present invention may be incorporated in any of a number of similar devices in which a lever arm - cam mechanism is desired. The cable 50 interrelates with the cam 4 of the cam assembly 2 by riding within a cable guide 22 around the circumferential perimeter of the cam 4. As hereinafter more fully described, the cable 50 is attached to a weight set 80 or other resistance force and, due to the interrelation of the cable 50 with the cam 4, the cable 50 translates the resistance force to the circumferential perimeter of the cam 4.

Still referring to FIG. 2, the cam 4 is preferably a flat, oval-shaped device designed such that the radius distance thereof varies along each point of the circumference thereof. The radius of the cam 4 serves as a lever arm when a resistance (such as that translated by the cable 50 ) is applied at the circumference of the cam 4. If the resistance is maintained in a particular direction against the cam 4 circumference and the cam 4 is rotated causing the resistance to be directed along each point of the circumference of the cam 4, the particular radius of the cam 4 serving as a lever arm then varies in accordance with the rotational position of the cam 4. The varying radius, and thus varying lever arm, of the cam 4 on rotation creates a desired variable resistance against a lift arm 32 incorporated with the cam 4. As will be readily apparent to one skilled in the art, the particular oval shape of the cam 4 determines the particular variable resistance which may be expected due to the cam 4. Accordingly, the oval shape of the cam 4 may take a large variety of oval shapes, each shape creating a different variable resistance effect. The present invention is effective with a wide range of oval-shaped characteristics of the cam 4 and, therefore, all such effective configurations are hereby included as forming the invention.

The cam 4 further includes in the sides thereof an array of positioning holes 10 each located an equiradial distance from the centrum 25 of the cam 4. At the centrum 25 of the cam 4 is located a cam rotation cuff 24 which serves as a cuff to encircle the rotational axis of the cam 4. Located at either side of the array of positioning holes 10 are rotation stops 14. The rotation stops 14 limit the rotational movement of the cam 4, when adjusted for initial positioning, to the angular distance between the rotation stops 14.

Also centrally located in, extending from and arcuately running along a side surface of the cam 4 is a guide ridge 12. The guide ridge 12 extends from the side surface of the cam 4 outwardly therefrom. It may vary in size, but in the present embodiment it extends outwardly about one inch and is formed in a select curve that is disposed outwardly from the centrum 25. The purpose of the guide ridge 12 is to provide a guide mechanism which, due to its rotatable relationship with the positioning piece 7 (as hereafter described) together with its simultaneous rolling, abutting engagement with the cable tension arm 54 pivotally attached to the positioning piece 7, maintains the cable 50 within the cable guide 22 around the circumferential perimeter of the cam 4 in a manner which limits slack in the cable 50 within the cable guide 22 but allows rotation of the cam 4 in relation to the cable 50 when the cam 4 is not locked in a position for lifting exercise (as hereinafter described ).

The particular arc and radial distances of the select curve of the guide ridge 12 from the centrum 25 are dictated based upon the oval-shaped characteristics of the cam 4. As previously described, the guide ridge 12 guides the cable tension arm 54, which is pivotally fixed in relation to the cam 4 by the positioning piece 7 (as hereafter described), to limit slack in the cable 50 around the cam 4 circumference but allows rotation of the cam 4 in relation to the cable when the cam 4 is not locked in position for lifting exercise. The particular arc and radial distance of the select curve of the guide ridge 12 are, therefore, set dimensions dependent upon the particular oval-shaped characteristics of the cam 4. A preferred method to determine the particular arc and radial distance of the select curve for a given application is to construct a wooden model of the cam 4, positioning piece 7, cable tension arm 54, and ridge roller guide 58. As hereinafter more fully described, the positioning piece 7, to which the cable tension arm 54 is pivotally attached (the ridge roller guide 58 being affixed at one arm of the cable tension arm 54), rotates independently of the cam 4 when the cam 4 is not locked in position for lifting exercise but rotates with the cam 4 when the cam 4 is so locked in position (the particular locking mechanism is hereinafter described in more detail). Once the wooden model is constructed, the model is mounted in the particular weight lifting machine 300 or other device. An end of a cable is then affixed towards the resistance force. The other end of the cable is wrapped generally around a desired portion of the circumference of the cam 4 model and affixed to the cable tension arm 54 of the model. As the cam 4 model is rotated, the positioning piece 7 is allowed to rotate independent of the cam 4 model. The positioning piece 7 and the cable tension arm 54 thereon are then manually positioned to maintain a desired tension on the cable sufficient to maintain the cable around the portion of the circumference of the cam 4 model. The various positioning of the positioning piece 7 and cable tension arm 54, and in particular the roller bearing of the cable extension arm 54, necessary to maintain the desired cable tension is then marked on the cam 4 model by a pencil or pen. As the process is repeated at approximately 10° intervals of rotation of the cam 4 model, the marks indicating the positioning of the roller bearing at such intervals outlines the desired arc and radius of the guide ridge for the particular cam 4 model shape. The model is then followed in forming the guide ridge 12 of the actual cam 4 device.

Figure 4A:
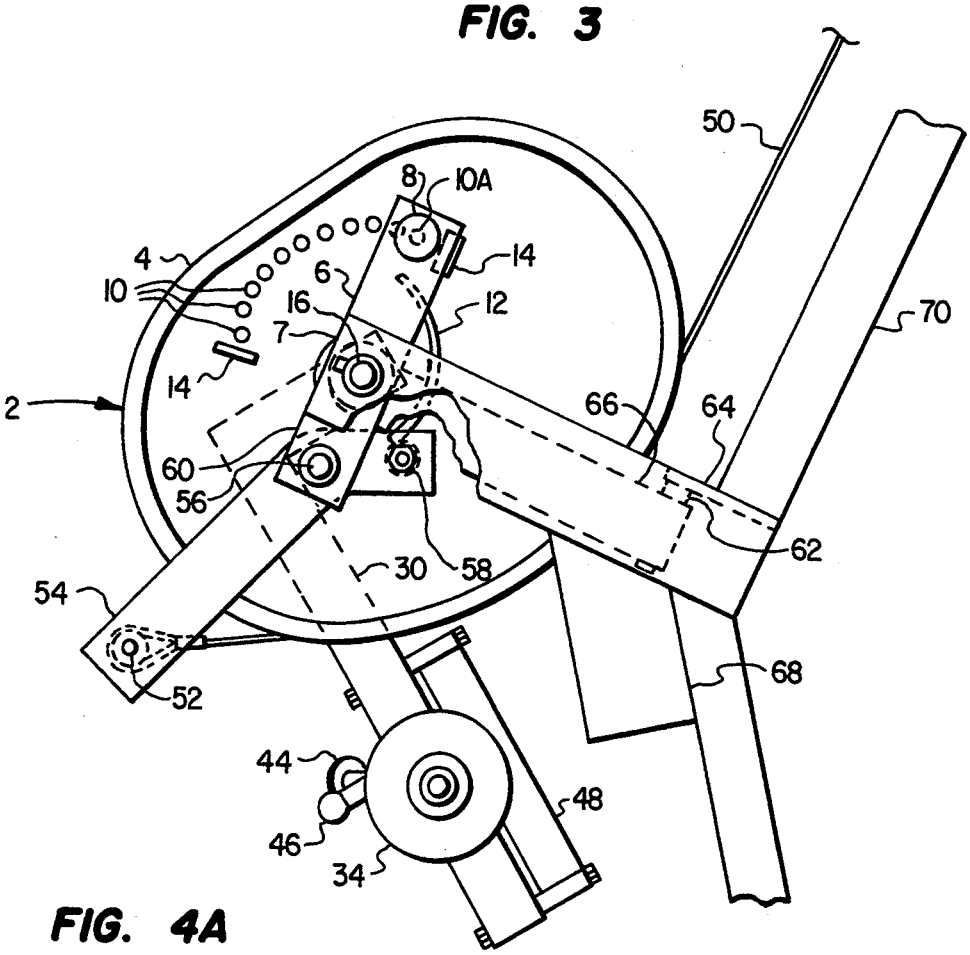
FIG. 4A is an enlarged, side elevational, fragmentary view of the adjustable lever arm - variable resistance cam assembly of FIG. 1, with portions cutaway to show the relationship between various members thereof when position arm is fixed in one extreme position.
Figure 4B:
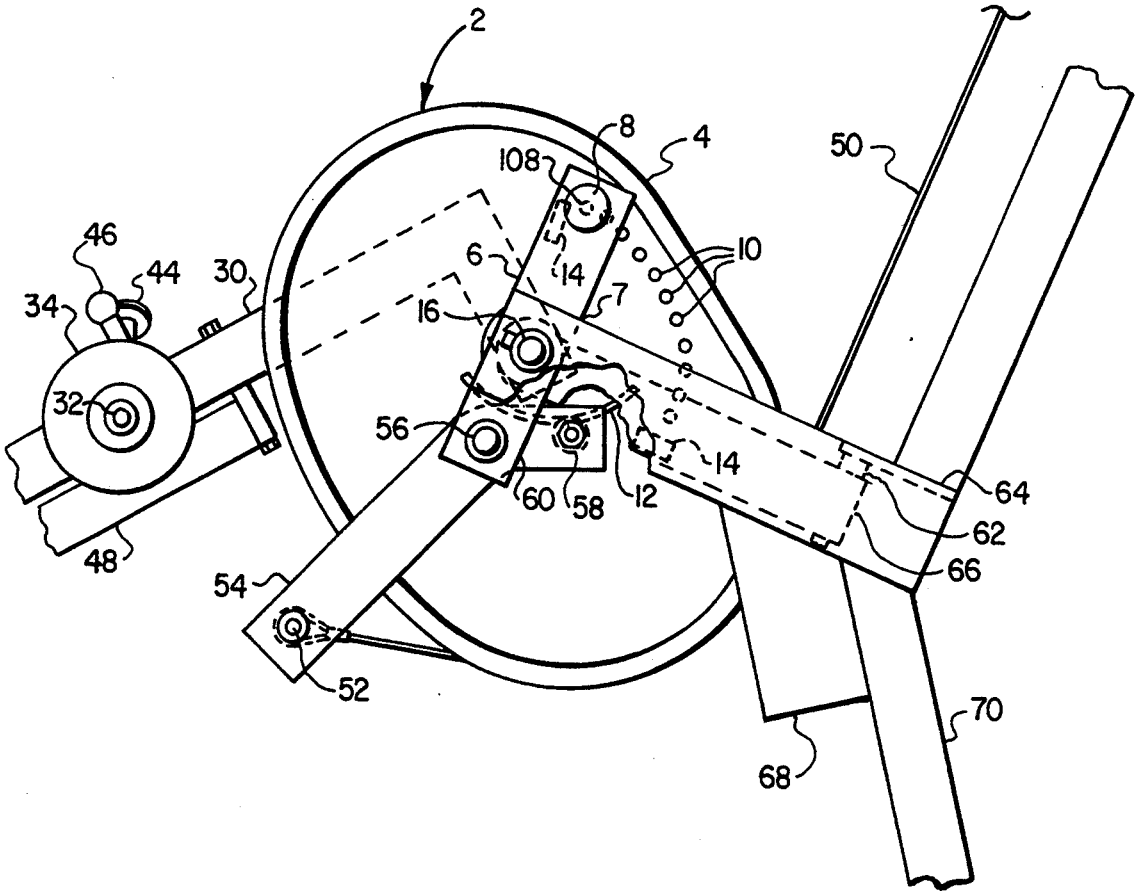
FIG. 4B is an enlarged, side elevational, fragmentary view of the adjustable lever arm - variable resistance cam assembly of FIG. 1, with portions cutaway to show the relationship between various members thereof when position arm is fixed in extreme position opposite positioning shown in FIG. 4A.

One distinguishing feature of the cam assembly 2 over the prior art is the particular aspects of the cam assembly 2 which make the lever arm of the cam assembly 2 adjustable without affecting the particular variable resistance effect of the cam assembly 2. Referring briefly now to FIGS. 4A and 4B in combination, a representative cam assembly 2, exhibiting certain novel aspects of the present invention, is shown adjusted for two different initial positions. It may be seen that the cam assembly 2 may be rotated in its position along the cable 50 when initial positioning of the cam assembly 2 is being adjusted, but, once adjusted and secured in initial position, rotation of the cam assembly 2 causes the cable 50 to rotate with such rotation, as the cable 50 then wraps securely around the circumferential perimeter of the cam 4.

FIG. 4A shows the cam assembly 2 adjusted for one initial position. When the cam assembly 2 is fixed in such initial position and the cam assembly 2 is rotated, the cable 50 which wraps around the cam 4 is maintained in a particular relationship to the cam 4 along the circumferential perimeter thereof. Alternatively, FIG. 4B shows the cam assembly 2 adjusted for another initial position. Like the cam assembly 2 shown in FIG. 4A, the cable 50 wraps around the cam 4 when the cam assembly 2 is rotated after being fixed in the initial position of FIG. 4B.

By comparing the relationship of the cable 50 to the cam 4 shown in each of FIGS. 4A and 4B, it is apparent that the cable 50 remains essentially stationary, except to the extent the cable may be moved to limit slack and maintain the cable in the cable guide, as the cam assembly 2 is adjusted to differing initial starting positions. Yet, as also shown in FIGS. 4A and 4B, the cable 50 wraps around the cam assembly 2 with rotation of the cam assembly 2 when the cam assembly 2 has been adjusted to and engaged in an initial position. Because the cam 4 is oval-shaped to create a desired variable resistance (as previously described herein), such a mechanism for adjusting initial positioning of the cam assembly 2 free of the resistance force maintains the particular variable resistance desired at each rotational position of the cam assembly 2 when engaged in a particular initial position. In practical terms, the cam assembly 2 may be rotatably adjusted to different initial positions free of the resistance force. Once adjusted to a desired initial position and engaged therein, however, the cam assembly 2 may only be rotated by application of rotational force thereto sufficient for overcoming the particular resistance force at each angular position of the cam assembly 2. The particular resistance force presented at various angular positions of the cam assembly 2 varies at the various angular positions due to the shape of the cam 4. The cam 4, being fixedly engaged at its circumferential perimeter with the cable 50, acts as a lever against the angular resistance force created by the cable 50 due to the weight set 80. As the cam assembly 2 is rotated during exercise, the cam 4 rotates. Since the cam 4 is oval-shaped, the radius (i.e., lever arm distance) varies according to angular positioning of the cam assembly 2. The weight set 80 provides a constant resistance force against the cam assembly 2. However, the cam assembly 2, due to the oval-shape of the cam 4, the radius of which serves as a lever arm at each angular position, creates a variable resistance force against which the user exerts weight lifting force during exercise.

A clear example of the present invention and its advance over the prior art is presented by a situation in which a user of a weight lifting machine 300, as shown in FIG. 1, is using the machine 300 in rehabilitating a knee injury. With certain knee injuries, the user is advised not to apply force to the knee when fully bent, but to strengthen the knee by applying force starting from only a partially bent position and then extending the knee against such force. It is preferable in such a weight lifting machine 300 that a variable resistance force be maintained in response to rotational movement during the weight lifting exercise. Such resistance force should be variable over the range of motion of the exercise but consistent with respect to each angular position during the exercise, e.g., less resistance at the beginning of motion, increasing resistance as motion begins to a peak approximately midway through the range of motion, then decreasing to completion of the range of motion. In the conventional weight lifting machines exhibited by the prior art, the cam assembly typically is not adjustable to varying initial positions such that the particular desired resistance at each angular position of the cam assembly is maintained or, if so adjustable, the cam assembly must be rotated against the resistance force into such varying initial positions. In the present invention, the cam assembly 2 instead is adjustable to varying initial positions, free of the resistance force, yet maintains the cam 4 in particular relationship to the cable 50 so as to maintain appropriate variable resistance across the range of motion of the cam assembly 2 during exercises, irregardless of initial position.

Referring back to FIG. 2 for further details of the cam assembly 2 of the present invention, rotation cuff sleeves 26 fit within the cam rotation cuff 24 on either side of the cam 4 in a manner which provides a rotation sleeve for the cam 4.

Opposite the side of the cam 4 having the guide ridge 12, the cam 4 is affixed with a fixed arm 30. The fixed arm 30 extends from approximately the centrum 25 of the cam 4 towards the circumferential perimeter thereof, and includes an angular bend 31 therein. The particular angular bend 31 employed in a certain instance is determined by the particular characteristics of the weight lifting device. In the particular embodiment of the weight lifting machine 300 shown in FIG. 1, the angular bend 31 appropriate for the application, shown in detail in FIG. 2, positions the fixed arm 30 as shown i n FIG. 1.

Still referring to FIG. 2, the lift arm 32, against which the user applies weight lifting force, is positioned by an adjustment sleeve 42 along the fixed arm 30. The adjustment sleeve 42 slides along the fixed arm 30 into a position such that an adjustment pin 46 incorporated in the adjustment sleeve 42 matches with a hole in the fixed arm 30 to lock the adjustment sleeve 42 in place. The adjustment sleeve 42 further incorporates an adjustment knob 44 which better enables the user in tightening the lift arm 32 in a particular position. The lift arm 32 may also include a lift pad 34 positioned around the lift arm 32. Such a lift pad 34 provides a cushion against which the user may exert force, thereby limiting the user's contact with the non-resilient material from which the lift arm 32 is typically formed. The fixed arm 30 may further incorporate a restricting clamp 48 affixed to the fixed arm 30 for limiting movement of the adjustment sleeve 42 therealong.

Still referring to FIG. 2 (but also shown in FIGS. 1, 4A and 4B), the cam assembly 2 is held in close connection with the cable 50 by means of a cable tension arm 54. The cable tension arm 54 is a dual-armed lever centered at a cable tension pin 56. One arm of the cable tension arm 54 provides a cable fixing hole 59 in which a cable securing bolt 52 is inserted. The cable 50 is secured thereto by such cable securing bolt 52. The cable affixed to the cable securing bolt 52 extends therefrom along the cable guide 22 around a semicircular portion of the circumferential perimeter of the cam 4, then to the weight set 80 where connected therewith. To provide for ease of movement of the cable 50 in response to force applied thereto, one or more pulleys 72 may be incorporated with the weight support frame 70, or otherwise, for guiding the cable 50. The other arm of the cable tension arm 54 incorporates a ridge roller guide 58. The ridge roller guide 58 which moves along the guide ridge 12 as the cam 4 is rotated (as hereinafter described in further detail).

The cable tension arm 54, by means of the cable tension pin 56, is rotatably incorporated with a positioning piece 7. The positioning piece 7 includes three arm extensions projecting from a central rotation sleeve 18. The first arm extension, a cable positioning arm 60, includes a tension pin sleeve 61 for accepting the cable tension pin 56 for rotational movement therein. The tension pin 56 and tension pin sleeve 61 may interconnect by means of various combinations of tension pin sleeves 57, tension pin washers 55 and tension pin lock collars 53, for example. A second arm extension of the positioning piece 7 is a bumper arm 66. The bumper arm 66 incorporates a bumper 62. The third arm extension is a positioning arm 6. The positioning arm 6 incorporates a position lock pin 8. As the cam 4 is rotated about the cam rotation cuff 24, which cam rotation cuff 24 is inserted within the rotation sleeve 18, the position lock pin 8 aligns with the array of positioning holes 10 for securing the cam 4 with respect to one of such positioning holes 10 in a particular angular position relative to the positioning piece 7. In a preferred embodiment, tolerances resulting from insertion of the cam rotation cup 24 into the rotation sleeve 18 may be limited or otherwise adjusted by inclusion of rings 28 therewith. A rotation pin 16 is inserted centrally through a cam support arm 20, the rotation sleeve 18, the cam rotation cuff 24, and the other cam support arm 20 in a manner to provide a central pivot axis for the cam 4 and rotation sleeve 18 assembly in relation to the fixed cam support arm 20.

Referring now to FIGS. 2, 4A and 4B, the specific functions of the ridge roller guide 58, guide ridge 12, bumper arm 66, bumper 62 and cable positioning arm 60 may be seen. These parts cooperate to contain the cable 50 within the cable guide 22 around the circumferential perimeter of the cam 4, allowing the cable 50 to slide along the cable guide 22 as the cam assembly 2 is rotated to an initial position, yet maintain the cable 50 in tension with and in fixed relation to such cable guide 22 when the cam assembly 22 is rotated in the lifting exercise. It is notable that the positioning piece 7, from which the cable positioning arm 60 and bumper arm 66 extend, is rigid and the cable positioning arm 60 and bumper arm 66 are designed with set extension positioning therefrom. The positioning piece 7 is stabilized in relation to the cam 4 by the rotation pin 16 on which the positioning piece 7 may rotate independent of rotation of the cam 4. Counterclockwise rotation (in FIGS. 4A and 4B) of the positioning piece 7 is limited however due to the bumper arm 66 and bumper 62 thereon which abuts the bumper stop 64 integrated and sturdily affixed to the weight support frame 70.

Rotatably affixed to the cable positioning arm 60 of the positioning piece 7 is the cable tension arm 54. The cable tension arm 54 is in effect a dual-armed lever having one end affixed to the cable 50 by means of the cable securing bolt 52 and the other end incorporating a ridge roller guide 58 designed to roll along the guide ridge 12 of the cam 4. When adjustment of the initial positioning of the cam assembly 2 is being made, the ridge roller guide 58, abutting the guide ridge 12 and in rolling engagement therewith, acts to rotate the cable tension arm 54 in a manner maintaining limited, but sufficient tension on the cable 50 to maintain the cable 50 within the cable guide 22 of the cam 4 while allowing the cam 4 to rotate in relation to the cable 50. The bumper 62 acts to provide additional, but limited, tolerance in movement of the positioning piece 7 to further allow such rotation of the cam 4.

Once the cam 4 is rotated to an appropriate initial position and locked in such position by the match of the position lock pin 8 with a positioning hole 10, the positioning piece 7 becomes thereby fixed in its relation to the cam 4. Thus, as the cam 4 is rotated in a lifting exercise, the positioning piece 7 rotates on the rotation pin 16 in synchrony with the cam 4. Such rotation of the positioning piece 7 causes rotation of the cable positioning arm 60 thereof. The cable tension arm 54 attached to the cable positioning arm 60 is maintained in a particular relationship to the positioning piece 7 due to the ridge roller guide 58 abutting and rolling with the curvature of the guide ridge 12. During such a lifting exercise, the guide ridge 12 maintains the cable tension arm 54 in a position which tensions the cable 50 in a manner sufficient to maintain the cable in fixed relationship with the circumferential perimeter of the cam 4 throughout rotation thereof. At the completion of a lifting step in a lifting exercise, the rotation of the cam 4 is reversed by the resistance force created by the weight set 80 (shown in FIG. 1) until the bumper 62 contacts the bumper stop 64 due to rotation of the positioning piece 7 in synchrony with the cam 4.

Figure 3:
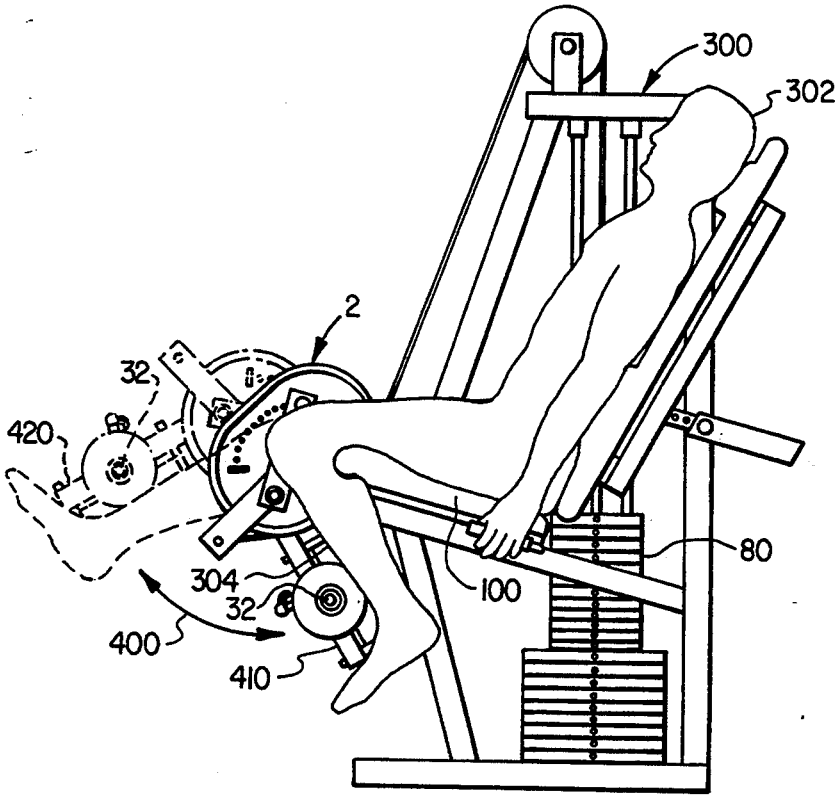
FIG. 3 is a side elevational view of the weight lifting machine of FIG. 1 illustrating a person seated thereon in phantom and initial lifting and extended positions of the lift arm during weight lifting exercise.

Referring now to FIG. 3, the weight lifting device 300 is seen in use. A user 302 is shown positioned on the user seat 100 in a manner as would be typical for a weight lifting device 300 of the type shown. The particular weight lifting device 300 shown in this embodiment is a knee flexing machine. The user's legs 304 are positioned in relation to the lift arm 32 such that the lift arm 32 may be rotatably moved by the user's leg 304 or by the resistance force due to the weight set 80 in the clockwise and counterclockwise directions of the arrow 400, respectively. Position 410 illustrates the lift arm 32 in the initial position prior to the user's exertion of force to lift the weight set 80. The position 420 (in phantom) shows the lift arm 32 in the extended position in which the application of force to lift the weight set 80 is complete.

Referring now to FIG. 4A, a detail of the adjustable lever arm - variable resistance cam assembly is seen. The positioning arm 6 is positioned relative to the cam 4 by positioning hole 10A. When the positioning arm 6 is so positioned with respect to cam 4, it is seen that the fixed arm 30 causes the lift arm 32 to be positioned as shown in FIG. 4A. It may be further noted from FIG. 4A the positioning of the cable 50 when the cam 4 and lift arm 32 are so positioned with respect to the positioning arm 6. The cable tension arm 54 floats with the positioning arm 6 since it is pivotally mounted thereto by the cable tension pin 56. Such floating of the cable tension arm 54, in accordance with movement of the ridge roller guide 58 along the guide ridge 12, keeps tension on the cable 50 to prevent slippage from the cable guide 22 (shown in FIG. 2) of the cam 4.

Referring now to FIG. 4B, an alternative positioning of the positioning arm 6 with respect to the cam 4 is seen. In this instance, the positioning arm is affixed at positioning hole 10B of the cam 4. As so positioned, the fixed arm 30 which rotates with the cam 4 is moved to a position such that the lift arm 32 is angularly rotated from the position thereof in FIG. 4A. It may be seen that even when the cam 4 is so rotated causing the lift arm 32 to be so positioned, the cable tension arm 54, due to the floating tendency created by the cable tension pin 56 and the movement along the guide ridge 12 of the ridge roller guide 58 of the cable tension arm 54, continues to keep the cable 50 affixed thereto tensioned to align within the cable guide 22 of the cam 4. With respect to the adjustable resistance effect of the present invention, it is seen by comparison of FIGS. 4A and 4B that, as the cam 4 is so repositioned as shown in the figures, the cam 4 slideably moves along the cable 50 in a manner such that the cam 4 is positioned in a select relation with the cable 50 in each particular case of positioning of the lift arm 32. This select relation of the cam 4 to the cable 50 at a particular position of the lift arm 32 is the same as the relation of the cam 4 to the cable 50 when the lift arm is rotated to the same position 32 during exercise. The cam's 4 oval-shape, which in effect varies the lever arm distance of the lever arm effect of the cam 4, thus causes the resistance effect against the lift arm to vary throughout the rotation of the lift arm 32 during exercise. Because the cam 4 is positioned in the select relation with the cable 50 in each particular position of the lift arm 32, however, the resistance against the lift arm 32 at each position of rotation is independent of the initial positioning of the lift arm 32.

The foregoing is intended merely as a detailed description of a preferred embodiment of the present invention. A wide variety of a number of alternative embodiments of the invention are possible. In one alternative embodiment, the adjustable lever arm - variable resistance cam assembly is incorporated in a weight lifting machine suitable for arm lifting exercises. In another alternative embodiment, the adjustable lever arm - variable resistance cam assembly is incorporated in a lifting device which is not intended for use in weight lifting exercise, but is nevertheless a lifting mechanism. Other possible alternative embodiments include lever arm adjustability beyond the range illustrated in the preferred embodiment wherein the cam includes a larger array of positioning holes 10 or other means for fixedly engaging the cam assembly 2 in a particular initial position. In another embodiment, the cable 50 is a chain. The embodiments listed herein are only illustrative of a wide range of embodiments possible for the present invention, and one skilled in the art, in light of the disclosures herein, could determine a wide variety of alternatives, all of which are included in the invention.

The invention may be constructed of a variety of materials. Preferably, the weight support frame 70 is formed of steel bar and sheet steel of high strength and is cut and welded to form the structure. Alternatively, the weight support frame 70 could be formed of a variety of types of steel or other strong materials, such as iron, wood, graphite, or others. In place of welding, the weight support frame 70 members could be glued, bolted, or molded to form a rigid structure. The weight set 80 is preferably formed of steel or iron of great weight and low ductility, however, other weighty objects or other force resistance means, for example, a motor, may be employed to create the resistance force. The user seat 100, seat back 102, and lift pad 34 are preferably formed of a cushiony foam, however, other resilient materials may be employed. The cam assembly 2 is also preferably formed of a sturdy steel material, however, other sturdy material such as iron, wood (in some instances), graphite, or others may be used. The cam 4 is preferably formed by molding, nevertheless, the cam 4 may be constructed by cutting, drilling and welding. The cam assembly 2 is held in place by a variety of bolts, nuts, and welds. A wide variety of fastening and fixing means could be employed in the invention for holding parts thereof together, as may be appropriate under particular and varied conditions.

As can be readily appreciated by one skilled in the art, alternative parts or configurations can be employed in constructing the present invention. It is believed that the operation and construction of the present invention will be apparent from the foregoing description. While the apparatus shown or described has been characterized as being preferred, it will be obvious that various changes and modifications therein may be made therein without departing from the spirit and scope of the invention. Further, the foregoing detailed description is to be clearly understood as being given by way of illustration and example only, the spirit and scope of the present invention being limited solely by the appended claims.

What is claimed is:

1. In a variable resistance cam assembly formed of a cam, a cable connected at one end to a weight set, and a positioning arm for selective engagement with said cam for rotatable engagement therewith, the improvement comprising a cable tension arm pivotally mounted to the positioning arm for select angulation relative thereto and concomitant positioning of said cable's other end relative to said cam, and means for imparting angulation of said positioning arm in response to rotation of said cam relative to said positioning arm, wherein said means is a guide ridge of said cam against which said cable tension arm is rollingly engaged in a manner causing said cable tension arm to angularly move to position said cable's other end relative to said cam when said cam is rotated with respect to said positioning arm.

2. The variable resistance cam assembly of claim 1, wherein said positioning arm is formed from a positioning piece, which positioning piece is rotatable in synchrony with said cam when engaged therewith and otherwise rotatable free of rotation of said cam, said cable tension arm being pivotally attached to said positioning piece.

3. In a variable resistance cam assembly formed of a cam, a cable connected at one end to a weight set, and a positioning arm for selective engagement with said cam for rotatable engagement therewith, the improvement comprising a cable tension arm pivotally mounted to the positioning arm for select angulation relative thereto and concomitant positioning of said cable's other end relative to said cam, and means for imparting angulation of said positioning arm in response to rotation of said cam relative to said positioning arm, wherein said positioning arm is formed from a positioning piece, which positioning piece is engageable with said cam for synchronous rotation therewith, said select angulation of said positioning arm and concomitant positioning of said cable's other end causing said cable to wrap around said cam when said positioning piece is engaged with said cam and allowing said cam to rotate relative to said cable when said positioning piece is disengaged from said cam, wherein a guide ridge affixed with said cam is abuttingly engaged with said cable tension arm for rotating said cable tension arm to cause said select angulation and concomitant positioning.

4. An adjustable lever arm - variable resistance cam assembly in a weight lifting device, said weight lifting device including a vertically movable weight set and a lift arm against which a user may exert force to lift said weight set, comprising:

a cable attached at one end thereof to said weight set;

a cam, rotatably secured upon said weight lifting device;

said cam having a cable guide around the circumferential perimeter thereof, said cable passing within said cable guide;

a lift arm securely connected with said cam such that rotation of said lift arm by said user exerting force thereagainst also rotates said cam;

a positioning arm rotatably mounted;

means for selectively securing said cam with said positioning arm for synchronous rotation thereof, said cam and said positioning arm synchronously rotating when said means is engaged, said cam and said positioning arm independently rotating when said means is not engaged;

a cable tension arm rotatably mounted to said positioning arm, said cable tension arm having dual arms, one of said arms including a cable securing pin secured with the other end of said cable, the other of said arms including a ridge roller guide; and a guide ridge incorporated with said cam, said guide ridge guiding said ridge roller guide of said cable tension arm for positioning said cable tension arm to appropriately tension said cable as necessary to maintain said cable within said cable guide of said cam, said guide ridge allowing engagement of said cable with said cable guide when said means for selectively securing said cam is not engaged, in a manner allowing said cam to freely rotate in relation to said cable, and providing for secure engagement of said cable with said guide ridge, in a manner allowing said cam to rotate with movement of said cable and said cable to move with rotation of said cam, when said means for selectively securing said cam is engaged.

5. The adjustable lever arm - variable resistance cam assembly of claim 4, wherein said cam is oval-shaped.

6. The adjustable lever arm - variable resistance cam assembly of claim 4, wherein said lift arm is adjustably positionable by said user linearly along said lift arm's rotational radius.

7. The adjustable lever arm - variable resistance cam assembly of claim 4, wherein said means for selectively securing said cam with said positioning arm is a position lock pin incorporated with said positioning piece for matching engagement with any of an array of positioning holes included in said cam to rotatably secure said positioning piece with said cam.

8. The adjustable lever arm - variable resistance cam assembly of claim 4, further comprising at least one rotation stop, said rotation stop limiting the rotational range of said cam when said positioning arm is not engaged by said means for selectively securing said cam such that said cam is freely rotatable in relation to said cable.

9. The adjustable lever arm - variable resistance cam assembly of claim 4, further comprising a bumper arm, said bumper arm functioning to restrict rotation of said cam when said positioning arm is engaged with said cam by said means for selectively securing said cam such that said cam is only rotatable by movement of said cable and said cable is only moveable by rotation of said cam.

10. The adjustable lever arm - variable resistance cam assembly of claim 4 further comprising a bumper arm formed from said positioning arm.

* * * * *